US006640445B1

(12) United States Patent
Crawford

(10) Patent No.: US 6,640,445 B1
(45) Date of Patent: Nov. 4, 2003

(54) BUOYANT CORDLESS ELECTRIC KNIFE AND FLASHLIGHT COMBINATION

(76) Inventor: Jeffrey Crawford, 1523 W. Blossom Dr., Menoken, ND (US) 58558

( * ) Notice: Subject to any disclaimer, the term of this patent is extended or adjusted under 35 U.S.C. 154(b) by 36 days.

(21) Appl. No.: 10/118,639

(22) Filed: Apr. 8, 2002

(51) Int. Cl.[7] ..... B26B 7/00
(52) U.S. Cl. ..... 30/277.4; 362/119
(58) Field of Search ..... 30/277.7, 123, 30/125, 340, 341, 526, 537; 83/473; 362/119, 120

(56) References Cited

U.S. PATENT DOCUMENTS

| | | | | | |
|---|---|---|---|---|---|
| 2,102,930 | A | | 12/1937 | Wharton | |
| 2,387,765 | A | * | 10/1945 | Monnet | 30/526 |
| 3,353,207 | A | | 11/1967 | Weinberger | |
| 3,370,163 | A | * | 2/1968 | Brill | 240/6.46 |
| D254,048 | S | | 1/1980 | Hauenstein | |
| 4,574,431 | A | | 3/1986 | Colling | |
| 4,711,030 | A | | 12/1987 | Ruston, Sr. | |
| 4,891,884 | A | | 1/1990 | Torbet | 30/277.4 |
| 4,920,612 | A | | 5/1990 | Moore | |
| D344,429 | S | | 2/1994 | Conroy | |
| D347,145 | S | | 5/1994 | Neshat et al. | |
| 5,313,376 | A | * | 5/1994 | McIntosh | 362/119 |
| D348,184 | S | | 6/1994 | Neshat et al. | |
| 5,822,866 | A | | 10/1998 | Pardue | |
| 5,852,875 | A | | 12/1998 | Dolah | |
| 5,931,307 | A | * | 8/1999 | Spradlin | 30/340 X |
| D421,367 | S | | 3/2000 | Naft et al. | |
| 6,206,538 | B1 | * | 3/2001 | Lemoine | 362/119 |
| 6,276,063 | B1 | | 8/2001 | Chen | |
| 6,434,836 | B1 | * | 8/2002 | Olivares | 30/277.4 |

* cited by examiner

*Primary Examiner*—Douglas D. Watts
(74) *Attorney, Agent, or Firm*—John D. Gugliotta

(57) ABSTRACT

A filleting knife is disclosed having a reciprocating, motor driven filleting blade mounted on a buoyant handle. A flashlight head is mounted on the handle opposite the knife. A rechargeable battery is housed within the handle and can power either the knife or the flashlight via separate on/off switches. The handle is contoured to fit a user's hand, and is circumscribed with additional buoyant foam that covers the outer surface of the handle such as to provide a sufficient additional buoyancy such as to allow the entire knife to float when dropped or placed in water.

11 Claims, 4 Drawing Sheets

BUOYANT CORDLESS ELECTRIC KNIFE AND FLASHLIGHT COMBINATION

RELATED APPLICATIONS

The present invention was first described in Disclosure Document Registration filed under 35 U.S.C. §122 and 37 C.F.R. §1.14. There are no previously filed, nor currently any co-pending applications, anywhere in the world.

BACKGROUND OF THE INVENTION

1. Field of the Invention

The present invention relates generally to fishing knives and, more particularly, to a reciprocating blade fillet style knife having a buoyant handle housing and integrated flashlight.

2. Description of the Related Art

In recent history, one improvement on conventional knife designs, the electric knife, has revolutionized the field by providing a knife having a reciprocating blade driven by an electric motor. Greatly reducing the amount of work required of the user, the electric knife turns monumental tasks such as turkey carving into a simple chore. Typically requiring the availability of an electric outlet, the use of these devices has been limited, however, to kitchens and other in-home applications. Additionally, when hunting or fishing it is often the case that multiple tools, such as a flashlight, are required in a manner that carrying multiple tools can be cumbersome and awkward. Still another need arises when on the water in that the accidental dropping of ANY tool will likely result in its permanent loss.

A search of the prior art did not disclose any patents that read directly on the claims of the instant invention; however, the following references were considered related.

The following patents disclose the ornamental design for an electric peeler;

U.S. Pat. No. D344,429 issued in the name of Conroy;

U.S. Pat. No. D254,048 issued in the name of Hauenstein.

U.S. Pat. No. 5,852,875 issued in the name of Dolah describes a battery-powered coring device.

U.S. Pat. No. 4,891,884 issued in the name of Torbet discloses a handholdable automatic balded appliance with rechargeable properties.

U.S. Pat. No. 4,711,030 issued in the name of Ruston Sr. describes a variable speed fillet knife.

U.S. Pat. No. D421,367 issued in the name of Naft et al. discloses the ornamental design for an electric knife.

U.S. Pat. No. D348,184 issued in the name of Neshat et al. describes the ornamental design for an electric fillet knife handle and base.

And, U.S. Pat. No. D347,145 issued in the name of Neshat et al. discloses the ornamental design for an electric knife handle.

While some features of providing an electric knife having a reciprocating blade that is driven by a rechargeable battery driven power supply adjustable may be incorporated into this invention as well as in other related references, other elements in combination are different enough as to make the combination distinguished over these related references.

SUMMARY OF THE INVENTION

Therefore, it is an object of the invention to indicate a device of the type disclosed above which avoids the disadvantages inherent in the state of the art. In particular, it is an object of the present invention to provide an improved electric knife having interchangeability of the various blades, in combination with the in-handle storage feature to provide safety as well as convenience.

Briefly described according to one embodiment of the present invention, an electric knife having a reciprocating blade that is driven by a rechargeable battery driven power supply. This lightweight, portable design, opens the doors to a variety of uses that are otherwise impossible with conventional cord powered models. Especially handy for fishermen and other outdoor users, the knife includes a variety of use specific blades such as filleting blades, utility blades and carving blades that allow the user to perform a multitude of tasks with ease and precision.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

1. Detailed Description of the Figures

Figure 1:
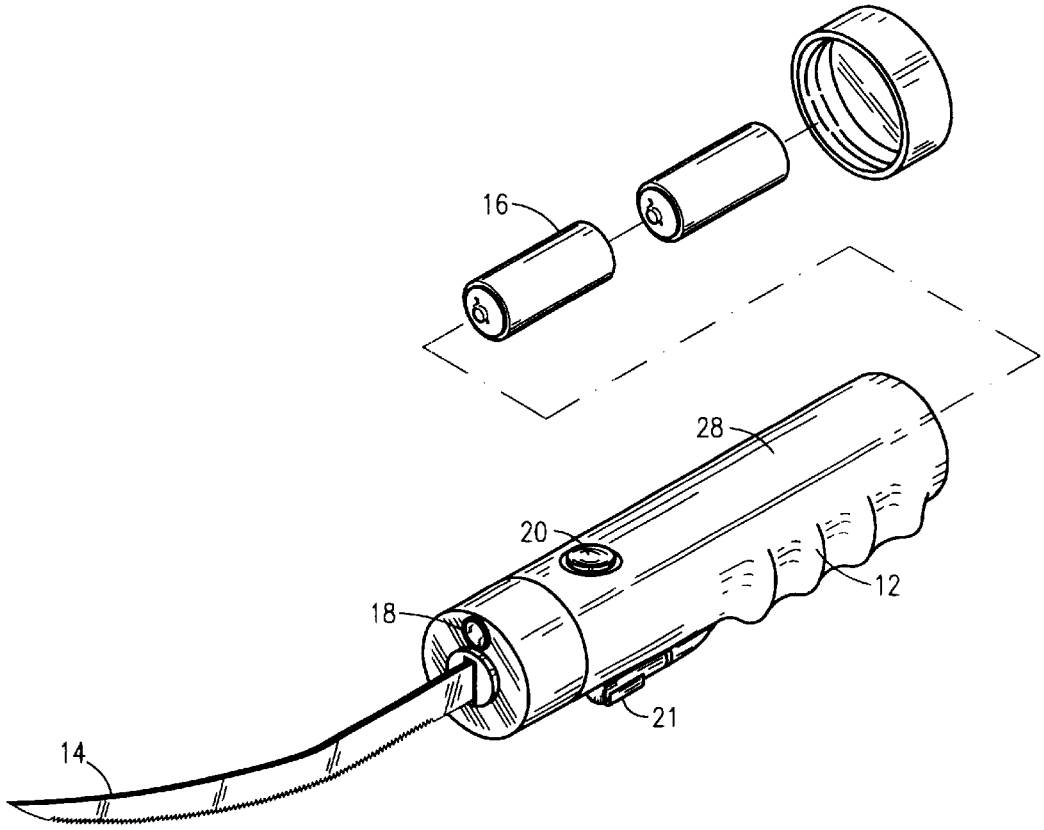
FIG. 1 is a partially exploded perspective view of a buoyant cordless electric knife and flashlight combination according to the preferred embodiment of the present invention.

Referring now to FIG. 1, a reciprocating blade, buoyant, cordless electric knife 10 shown, according to the present invention, having a contoured handle 12 that supports a reciprocating filleting blade 14 that is capable of being disposed within the handle 12 for storage. Device 10 is for use by the sportsman in the field for cutting and serrating fish, fowl, and game. A rechargeable battery 16, or plurality of rechargeable batteries 16 are also disposed within the handle 12 for supplying power to a small electric motor that drives the reciprocating blades 14. Further, the electrical supply is alternately used to power a flashlight 18 mounted on the handle 12 opposite the blade 14. A first control switch 20 is mounted on the handle 12 for controlling the blade 14; a second control switch 21 is mounted on the handle 12 for controlling the light 18.

Referring now to FIGS. 2–6, shown is a side view of the cordless electric knife 10 displaying the location of the important features of the device. Located at the front of the device is a motorized head 25 for providing a base for the blade receiving slot/locking mechanism 26 is located for receiving blade 14 (not shown). Motorized head 25 is connected to the handle 12 which also serves as the housing for storing the blades 14 and battery 16 (not shown). Opposite the motorized head 25 is a flashlight head 18 that threadingly engages on the housing 12. A watertight, pliant seal 27 circumscribing the outer housing circumference and inner flashlight head circumference such that when the head 18 is threaded to the housing 12 the internal batter cavity can be isolated from the outer surroundings. In such a fashion the entire knife 10 is water-tight and buoyant.

The handle 12 is generally an elongated hollow cylinder flared outward at one end and having a sidewall at that end. Handle 12 and the housing for motorized head 25 may be constructed from a plastic having a closed cellular structure formed via a blowing agent such as to create a handle 12 that is naturally buoyant. This natural buoyancy, in addition to any entrained air trapped inside an airtight, sealed inner cavity, helps to make the entire knife 10 buoyant. Because the blade 14, light 18, and especially batteries 16 are conventionally formed of heavier, non-buoyant material, an additional buoyant foam 28 covers the outer surface of the handle 18 such as to provide a sufficient additionally buoyancy such as to allow the entire knife 10 to float when dropped or placed in water.

Located directly behind motorized head 25 on the top of the exterior sidewall of handle 12 is a power switch 17 for controlling the flow of electrical current to motor housed within the motorized head 25. Located directly behind motorized head 25 on the bottom of the exterior sidewall of handle 21 is a second power switch 18 for controlling the flow of current to the flashlight 18.

Figure 2:
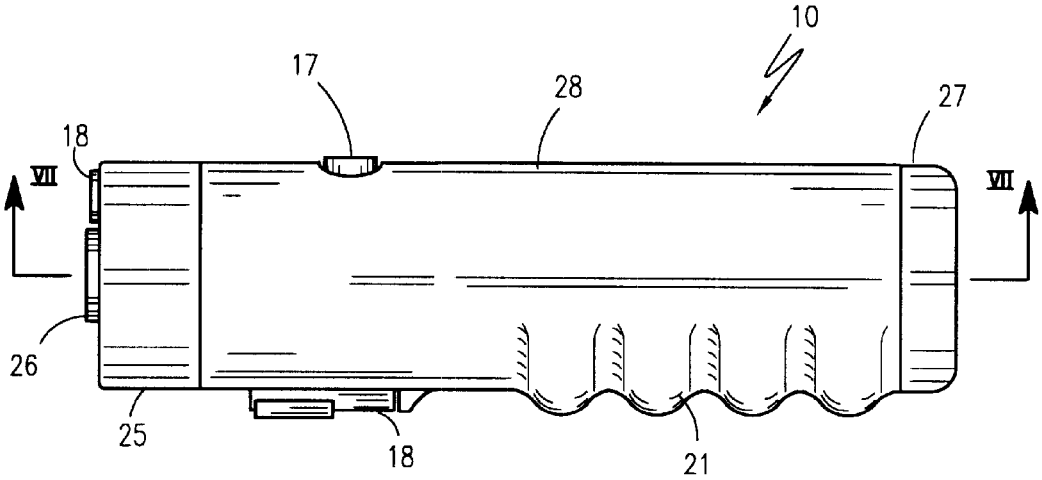
FIG. 2 is a side elevational view thereof.
Figure 3:
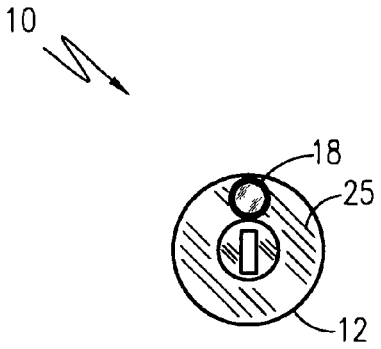
FIG. 3 is a front end view thereof.
Figure 5:
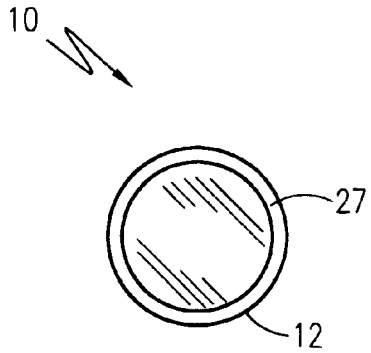
FIG. 5 is a rear end view thereof.
Figure 4:
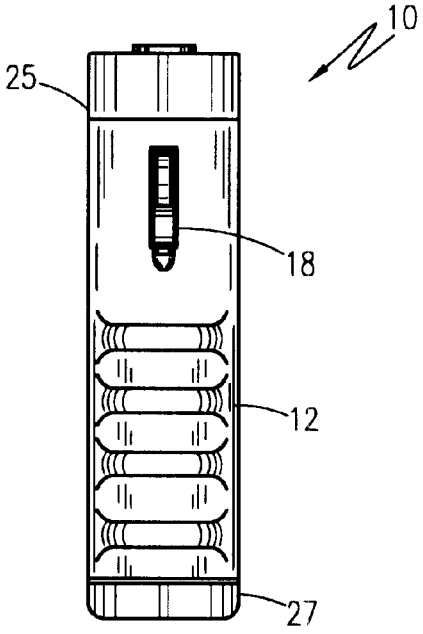
FIG. 4 is a bottom elevational view thereof.
Figure 6:
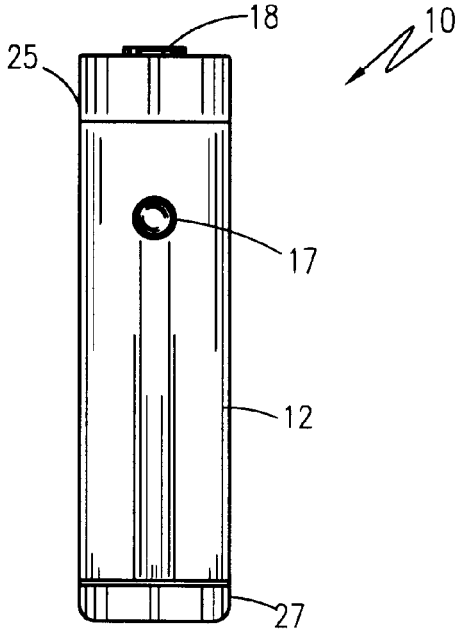
FIG. 6 is a top elevational view thereof.
Figure 7:
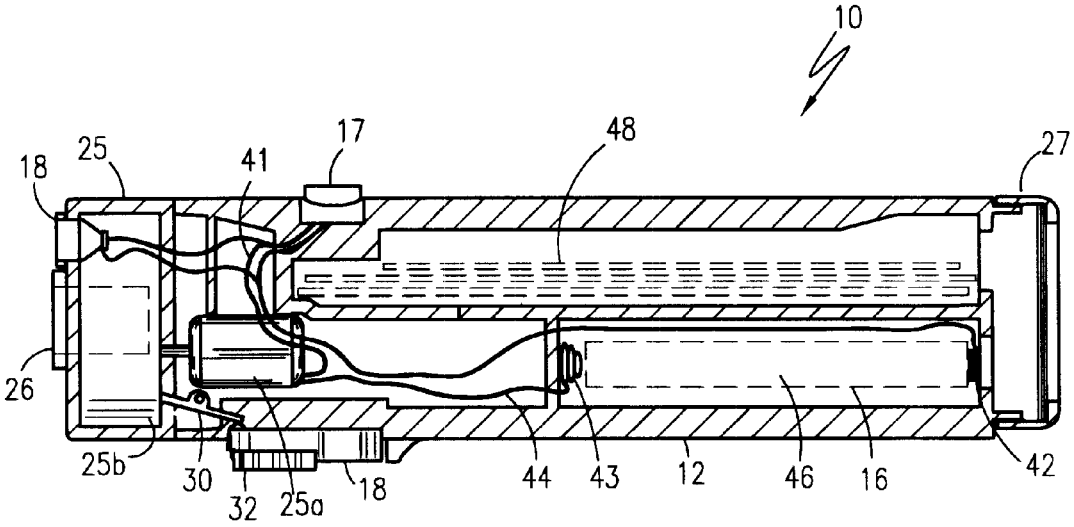
FIG. 7 is a top cutaway view thereof taken along line VII—VII of FIG. 2.

Referring now to FIG. 7, a cutaway top view of device 10 is shown taken along line VII—VII of FIG. 2 along the elongated longitudinal axis of handle 12. Gear Box 25*b* is disposed within motorized head 25. Gear Box 25*b* is driven by electric motor 25*a* and converts the rotational energy of electric motor 25*a* to a reciprocating back and forth motion in the blade receiving slot/locking mechanism 26 for driving the cutting blades 14. Blade Receiving Slot/Locking Mechanism 26 is located in the center of motorized head 25. A linkage 30 connects Blade Receiving Slot/Locking Mechanism 26 to blade release button 32. Electric motor is supplied power via switched power wire 41 linked via power switch 17 from the positive battery contact 42. The negative pole of electric motor 25*a* is connected to the negative battery contact 43 via ground wire 44. Positive battery contact 42 is disposed within battery compartment 46 located on the interior of handle 12 on the inside of battery compartment cover. The negative battery contact 43 is located to the front end of battery compartment 46. Battery 16 is placed within battery compartment 46 secured by the threaded flashlight head 18. Battery 16 is a rechargeable type battery that is typical of modern rechargeable tools and devices being an elongated cylinder with a positive pole on one end and a negative pole on the other. Such batteries are typically charged on a battery charger that sits on a counter type and is plugged into conventional household power outlets. Located above battery compartment 46 is cutting blade compartment 48, an elongated cavity within handle 12, for storing a plurality of cutting blades 16 that can be inserted into blade receiving slot/locking mechanism 26.

2. Operation of the Preferred Embodiment

To use the present invention as a knife, one inserts a pair of blades into the slot in the front of the motorized head. The slot is designed to lock the blades into the motorized and mechanically connect the blades to the electric motor. A plurality of blades of different shapes are stored in the interior of the handle. A small door with a locking tab will allow a user to access the blades. A power switch on the handle energizes the motor with electrical power from the battery. One simply pushes the power switch to energize the device. The device can be used to cut or fillet fish, fowl, or game. When one is done using the device, the power is switched off and the blades removed from the motorized head by pushing a release button on the bottom of the handle. The blades can now be cleaned and stored with the other blades. The battery may also be removed and recharged by putting it in the included counter top recharger powered by household current. The battery is accessed by opening a small door with a locking tab covering the battery compartment.

To use the present invention as a flashlight, one would engage the first switch 17 alternately to turn the light 18 on or off.

As designed, a device embodying the teachings of the present invention is easily applied. The foregoing description is included to illustrate the operation of the preferred embodiment and is not meant to limit the scope of the invention. As one can envision, an individual skilled in the relevant art, in conjunction-with the present teachings, would be capable of incorporating many minor modifications that are anticipated within this disclosure. Therefore, the scope of the invention is to be broadly limited only by the following claims.

What is claimed is:

1. A cordless electric knife comprising:

a reciprocating blade fillet style knife having a buoyant, water tight handle housing and housing a small electric motor that drives reciprocating blades; and a flashlight integrated within said handle;

wherein said entire knife is water-tight and buoyant.

2. The knife of claim 1, wherein said handle housing forms a contoured handle.

3. The knife of claim 1, wherein said reciprocating fillet style blade is capable of being disposed within said handle for storage.

4. The knife of claim 1, wherein said electric motor and said flashlight are each powered by batteries disposed within said handle.

5. The knife of claim 1, further comprising first control switch mounted on said handle and in electrical communication with said motor for controlling said blade.

6. The knife of claim 5, further comprising a second control switch mounted on said handle and in electrical communication with said flashlight for controlling said flashlight.

7. The knife of claim 1, having a motorized head or providing a base for a blade receiving slot/locking mechanism for receiving blades and connected to said handle.

8. The knife of claim 7, having a flashlight head opposite said motorized head that threadingly engages on the housing and having a watertight, pliant seal circumscribing an outer housing circumference and inner flashlight head circumference such that when said head is threaded to the housing the internal batter cavity can be isolated from the outer surroundings.

9. The knife of claim 1, wherein said handle is constructed from a plastic having a closed cellular structure formed via a blowing agent such as to create a handle that is naturally buoyant.

10. The knife of claim 7, further comprising a gear box disposed within said motorized head, said gear box driven by said electric motor and converts the rotational energy of electric motor to a reciprocating back and forth motion in the blade receiving slot/locking mechanism for driving the cutting blades.

11. The knife of claim 10, further comprising a blade receiving slot/locking mechanism located in the center of said motorized head and in physical communication with a linkage for connecting said blade receiving slot/locking mechanism to a blade release button.

* * * * *